US008713906B2

(12) United States Patent
Yaniv et al.

(10) Patent No.: US 8,713,906 B2
(45) Date of Patent: May 6, 2014

(54) COMPOSITE COATING FOR STRINGS

(75) Inventors: Zvi Yaniv, Austin, TX (US); Dongsheng Mao, Austin, TX (US)

(73) Assignee: Applied Nanotech Holdings, Inc., Austin, TX (US)

( * ) Notice: Subject to any disclaimer, the term of this patent is extended or adjusted under 35 U.S.C. 154(b) by 22 days.

(21) Appl. No.: 13/481,145

(22) Filed: May 25, 2012

(65) Prior Publication Data

US 2012/0237767 A1 Sep. 20, 2012

Related U.S. Application Data

(63) Continuation-in-part of application No. 11/940,976, filed on Nov. 15, 2007.

(60) Provisional application No. 60/866,199, filed on Nov. 16, 2006.

(51) Int. Cl.
*D02G 3/36* (2006.01)

(52) U.S. Cl.
USPC ..... 57/232; 57/258

(58) Field of Classification Search
USPC ..... 57/230, 232, 258
See application file for complete search history.

(56) References Cited

U.S. PATENT DOCUMENTS

| | | | | |
|---|---|---|---|---|
| 1,770,794 A | | 7/1930 | Mathey | |
| 1,974,453 A | | 9/1934 | Gallaudet | |
| 3,605,399 A | | 9/1971 | Van Rijswijk | |
| 3,840,427 A | | 10/1974 | Brazier et al. | |
| 4,016,714 A | | 4/1977 | Crandall et al. | |
| 4,377,620 A | | 3/1983 | Alexander | |
| 4,499,144 A | | 2/1985 | Van Rijswijk | |
| 4,739,007 A | | 4/1988 | Okada et al. | |
| 4,770,915 A | | 9/1988 | Nakagawa et al. | |
| 4,860,531 A | * | 8/1989 | Wells et al. | 57/234 |
| 5,327,714 A | * | 7/1994 | Stevens et al. | 57/230 |
| 5,536,005 A | | 7/1996 | Koff | |
| 5,552,469 A | | 9/1996 | Beall et al. | |
| 5,578,672 A | | 11/1996 | Beall et al. | |
| 5,698,624 A | | 12/1997 | Beall et al. | |
| 5,747,560 A | | 5/1998 | Christiani et al. | |

(Continued)

FOREIGN PATENT DOCUMENTS

| | | |
|---|---|---|
| EP | 1574234 A1 | 9/2005 |
| JP | 04109972 | 4/1992 |

(Continued)

OTHER PUBLICATIONS

European Patent Office, Notice of Allowance, Application No. 07864530.6, dated Jun. 6, 2011, 6 pages.

(Continued)

*Primary Examiner* — Shaun R Hurley
(74) *Attorney, Agent, or Firm* — Kelly Kordzik; Matheson Keys & Kordzik PLLC

(57) ABSTRACT

A buffer layer is used to coat on the multi-filament wrapped string to fill the gaps. The polymers of the buffer-layer coating have a high melt-flow (low viscosity) during coating process to fill all the gaps between the filaments, and the filaments are fixed by the coatings onto base core materials. An outer protective coating is applied, which may comprise a composite nylon, clay nanoparticles, carbon nanotubes, an impact modifier, or any combination of the foregoing.

18 Claims, 7 Drawing Sheets

(56) References Cited

U.S. PATENT DOCUMENTS

| | | | | |
|---|---|---|---|---|
| 5,760,121 | A | 6/1998 | Beall et al. | |
| 5,849,830 | A | 12/1998 | Tsipursky et al. | |
| 5,877,248 | A | 3/1999 | Beall et al. | |
| 5,952,095 | A | 9/1999 | Beall et al. | |
| 6,062,014 | A * | 5/2000 | Yeh | 57/232 |
| 6,232,388 | B1 | 5/2001 | Lan et al. | |
| 6,311,359 | B1 * | 11/2001 | Brezler, III | 15/159.1 |
| 6,371,318 | B1 | 4/2002 | Riffer | |
| 6,399,690 | B2 | 6/2002 | Lan et al. | |
| 6,423,369 | B1 | 7/2002 | Yoshimura et al. | |
| 6,460,321 | B1 | 10/2002 | Koshimae et al. | |
| 6,521,054 | B2 | 2/2003 | Arai et al. | |
| 6,527,875 | B2 | 3/2003 | Arai et al. | |
| 6,551,418 | B2 | 4/2003 | Arai et al. | |
| 6,586,500 | B2 | 7/2003 | Bagrodia et al. | |
| 6,677,016 | B2 | 1/2004 | Riffer | |
| 6,737,464 | B1 | 5/2004 | Bagrodia et al. | |
| 6,790,296 | B2 | 9/2004 | Kanekiyo et al. | |
| 6,828,370 | B2 | 12/2004 | Lan et al. | |
| 6,835,454 | B1 | 12/2004 | Randa et al. | |
| 6,855,265 | B2 | 2/2005 | Arai et al. | |
| 6,890,392 | B2 | 5/2005 | Kanekiyo et al. | |
| 6,893,730 | B2 | 5/2005 | Moulton et al. | |
| 6,951,625 | B2 | 10/2005 | Arai et al. | |
| 7,037,562 | B2 | 5/2006 | Jimenez | |
| 2001/0035002 | A1 * | 11/2001 | Carr | 57/244 |
| 2003/0143396 | A1 | 7/2003 | Bouquerel et al. | |
| 2003/0145574 | A1 | 8/2003 | Delvael | |
| 2004/0096389 | A1 | 5/2004 | Lobovsky et al. | |
| 2005/0245333 | A1 | 11/2005 | Akagi et al. | |
| 2008/0206559 | A1 * | 8/2008 | Li et al. | 428/368 |

FOREIGN PATENT DOCUMENTS

| | | |
|---|---|---|
| JP | 09010368 | 1/1997 |
| JP | 2003-126643 | 5/2003 |
| JP | 2004-202000 | 7/2004 |
| WO | WO 99/41299 | 8/1999 |
| WO | WO 2006/096203 | 9/2006 |
| WO | WO 2008/061229 | 5/2008 |

OTHER PUBLICATIONS

Alekseev et al., "Methods for Purification of Carbon Nanotubes Obtained from Fullerene Production Deposits" Russian Journal of Applied Chemistry, vol. 78, No. 12, pp. 2019-2021, Jun. 2, 2005.

Cho et al., "Nylon 6 Nanocomposites by Melt Compounding" *Polymer*, vol. 42, 2001, pp. 1083-1094, Feb. 24, 2000.

European Patent Office, EPO Communication for Application No. 07864530.6, Mar. 8, 2010, 6 pages.

Exxelor VA 1840 Product Description, ExxonMobile Chemical Inc., (2 pages) [Online], [Retrieved on Sep. 16, 2008]. Retrieved from the Internet: <URL: http://www.exxonmobilchemical.com/Public_Files/EEB/Functionalized_Polymers/Worldwide/Data_Sheet_Exxelor_Maleic_Anhydride_Functionalized_EP_VA_1840.pdf.

Fornes et al., "Nylon-6 Nanocomposites from Alkylammonium-Modified Clay": The Role of Alkyl Tails on Exfoliation; *Macromolecules*; vol. 37, No. 5, pp. 1793-1798, Jan. 29, 2004.

The International Bureau of WIPO, International Preliminary Report on Patentability mailed on May 28, 2009; PCT/US2007/084973; 9 pages.

European Patent Office, International Search Report mailed on Apr. 4, 2008; PCT/US2007/084973; 13 pages.

Lam, Chun-ki et al.; Effect of Ultrasound Sonication in Nanoclay Clusters of Nanoclay/Epoxy Composites; *Materials Letters*; vol. 59, pp. 1369-1372; Jan. 18, 2005.

Mhetre, Shamal et al.; Nanocomposites with Functionalized Carbon Nanotubes; *Mat. Res. Soc. Symp. Proc.*; vol. 788, pp. L11.17.1-L11.17.6, publication date unknown.

Notification of Transmittal of the International Search Report and the Written Opinion of the International Searching Authority regarding PCT US2008/054964 dated Jul. 30, 2008 from the European Patent Office.

Ratna, D et al.; Clay-reinforced Epoxy Nanocomposites; *Polymer International*; vol. 52, 2003, pp. 1403-1407, 2003.

Salahuddin, N. et al.; Nanoscale Highly Filled Epoxy Nanocomposite; *European Polymer Journal*; vol. 38, pp. 1477-1482, May 8, 2000.

Zhang, Kailiang et al.: Preparation and Characterization of Modified-Clay-Reinforced and Tough Epoxy-Resin Nanocomposites; *Journal of Applied Polymer Science*; vol. 91, 2004, pp. 2649-2652, Jan. 24, 2003.

Zytel 7335F NC010 Product Information, Dupont Engineering Polymers (3 pages) [Online], [Retrieved on Sep. 16, 2008]. Retrieved from the Internet: <URL: http://plastics.dupont.com/plastics/dsheets/zytel/ZYTEL7335FNC010.pdf.

The Patent Office of the State Intellectual Property Office of the People's Republic of China, The First Office Action, Application No. 200780042703.9 dated Mar. 25, 2010, 7 pages.

First Office Action, Notice of Reasons For Rejection, Application No. 2009-537390, mailed Jul. 19, 2011.

The State Intellectual Property Office of the People's Republic of China, Notice of the Second Office Action, Application No. 200780042703.9, Nov. 10, 2011, 8 pages.

Pinto, Moises L., "Formulation, Preparation, and Characterization of Polyurethane Foams" Journal of Chemical Education, vol. 87, No. 2, Feb. 2010, pp. 212-215.

Seymour et al., "Polyurethanes: A Class of Modern Versatile Materials" Products of Chemistry, vol. 69, No. 11, Nov. 1992, pp. 909-910.

The International Bureau of WIPO, International Preliminary Report on Patentability, PCT/US2008/054964, Sep. 3, 2009, 7 pages.

* cited by examiner

COMPOSITE COATING FOR STRINGS

This application is a continuation-in-part application of U.S. patent application Ser. No. 11/940,976, which claims priority to U.S. Provisional Application Ser. No. 60/866,199, which is hereby incorporated by reference hereby.

TECHNICAL FIELD

The present invention relates in general to composite coatings for strings, such as used on sports racquets.

BACKGROUND AND SUMMARY

The strings for sports equipment (e.g., tennis racquets) or musical instruments are usually coated with a thin layer at their outmost surface to improve their durability, spin, feeling, etc. Polyamide (nylon), polyester, and other polymers have been used to coat on strings. Nanocomposites, such as clay and carbon nanotube reinforced nylon 6 nanocomposites, having better physical properties than neat nylon 6, provide highly durable string coating materials with other functionalities. The reinforcing polymeric composites using nano-sized clay particles with high aspect ratio have been investigated since the 1980's (see U.S. Pat. No. 4,739,007). Strings are usually polymer materials with a multi-layer structure—core filament, wrapping filaments on the core filament, and coating. For the strings with multi-layer structures, coating materials are required to match the base materials and have good melt-flow properties (acceptable viscosity) at certain temperatures to enable them to penetrate into the gaps between the wrapping filaments. However, the viscosity of a nanocomposite is typically higher than the viscosity of neat nylon 6 at the same temperature. Thus, the nanocomposite may not easily penetrate into the gaps between the wrapping filaments. FIG. 1 shows an SEM image of a cross-section view of a nylon 6/clay nanocomposite coated on a wrapping filament, which shows that the nanocomposite material did not successfully fill in all of the gaps. The result is that many defects were left in the string resulting in an unacceptable durability of the strings. The gaps will result in chipping-off or unacceptable durability of coatings during high impact hitting of balls. Moreover, due to the creation of the gaps, these coatings also fail to sufficiently bond the filaments onto the core materials of the string. FIG. 2 is an SEM image showing the chipped materials from filaments and coatings after high impact tests on such strings coated in this manner.

DETAILED DESCRIPTION

Although polymer nanocomposites have higher physical and mechanical properties than neat polymer materials, they also possess a higher viscosity or melt-flow during an extrusion or coating process. To solve this problem, a thin buffer layer is used to coat on the multi-filament wrapped string to fill the gaps. The polymers of the buffer-layer coating have a high melt-flow (low viscosity) during coating process to fill all the gaps between the filaments, and the filaments are fixed by the coatings onto the base core materials.

Example 1

A Composite String with a Nylon 6 Buffer Layer

Figure 1:
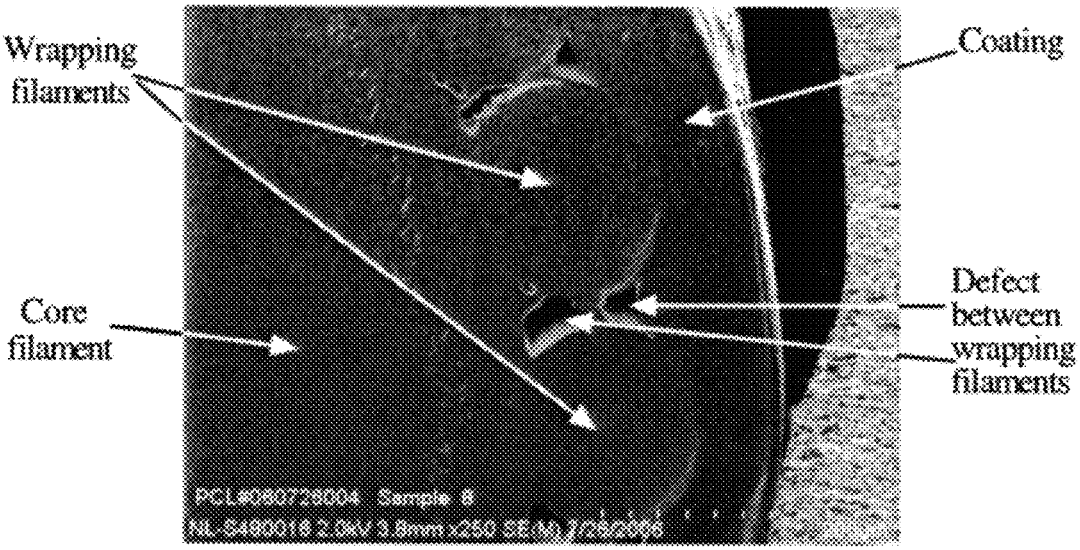
FIG. 1 shows an SEM image of a cross-section view of a nylon 6/clay nanocomposite coated on a wrapping filament.
Figure 2:
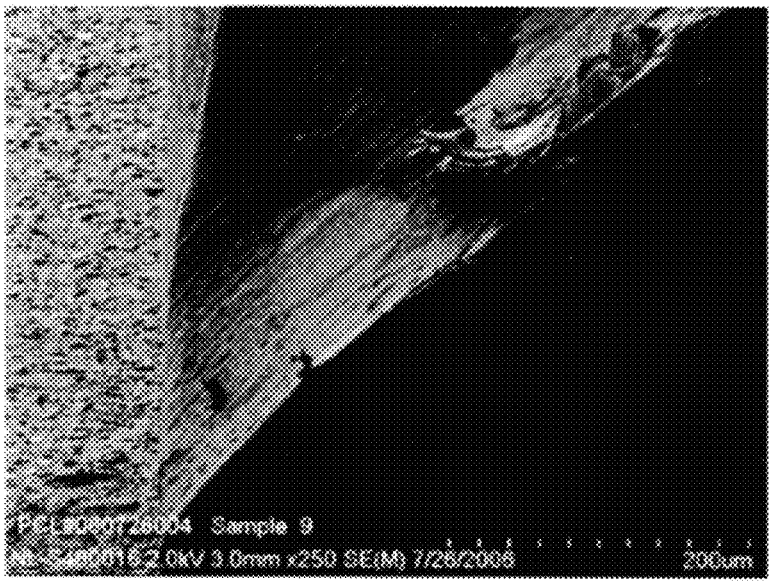
FIG. 2 shows an SEM image of chipped materials from filaments and coatings after high impact tests on a string.
Figure 3A:
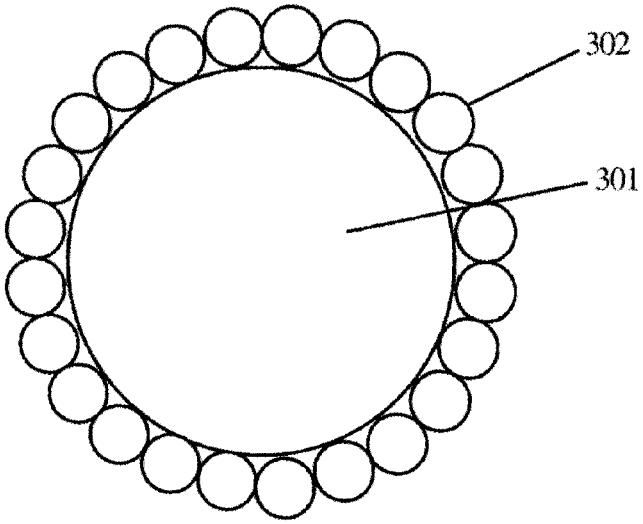
FIG. 3A illustrates a cross-section of a core filament of a string with wrapping filaments surrounding it.
Figure 3B:
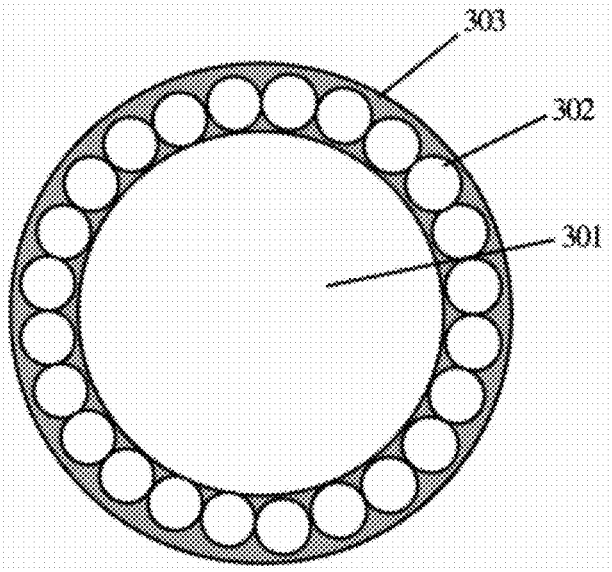
FIG. 3B illustrates a buffer layer applied onto the wrapping filament.

FIG. 3A illustrates a cross-section of a string for coating comprised of a monofilament core 301 wrapped with smaller diameter multi-filaments 302. Neat nylon 6 pellets (e.g., as may be commercially obtained from UBE Industries Inc. (product name: UBE SF 1018 A)) were melted. Referring to FIG. 3B, the neat nylon 6 buffer layer coating 303 was applied (e.g., by an extrusion process at temperatures ranging from approximately 220° C. to 270° C.). The thickness of the buffer layer 303 may be from 10 to 100 micrometers. The gaps between the multi-filaments 302 were substantially fully filled by the neat nylon 6 coating 303.

Figure 3C:
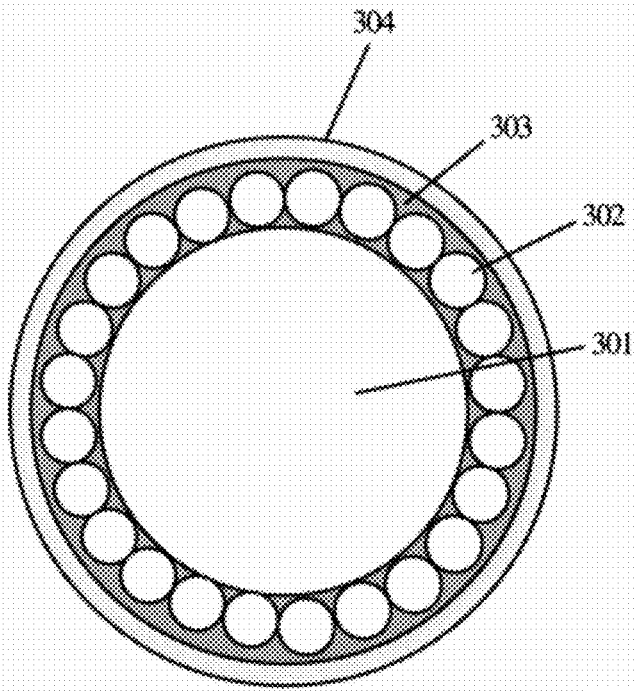
FIG. 3C illustrates a coating applied onto the buffer layer.

Referring to FIG. 3C, a wear-resistant coating 304 was then coated onto the string (e.g., by an extrusion process at temperatures ranging from approximately 240° C. to 280° C.). A nylon 6/clay, nylon 6/carbon nanotube (CNT) nanocomposite, or a clay/CNT co-reinforced nylon 6 nanocomposite may be employed as the wear-resistant coating material 304. The nylon 6 nanocomposite produced by in-situ polymerization may contain 4% nano-clay filler. Other nylon 6 nanocomposites produced by a melt-compounded process may also be used for the wear-resistant coating material 304. Except for the clay, carbon nanotubes, ceramic panicles such as $SiO_2$ and $Al_2O_3$, or glass particles may be used to make such nylon 6 nanocomposites. Any of the foregoing, nylon 6 nanocomposites may also be modified by an impact modifier, such as rubber or elastomer, to improve the ductility and toughness. The thickness of the wear-resistant coating 304 may be from 1 to 100 micrometers.

Example 2

A Composite String with a Nylon 11 Buffer Layer

Again referring to FIG. 3A, the string for coating is a monofilament core 301 wrapped with smaller diameter multi-filaments 302. Neat nylon 11 (e.g., as may be commercially obtained from ARKEMA Inc.) was melted. Nylon 11 has a very good melt flow at temperatures over 220° C. Good impact strength and shear strength also make nylon 11 a good buffer layer material. In FIG. 3B, the neat nylon 11 buffer layer coating 303 was applied (e.g., by an extrusion process at temperatures ranging from approximately 190° C. to 270° C.). The thickness of the buffer layer 303 may be from 10 to 100 micrometers. The gaps between the multi-filaments 302 were substantially fully filled by the neat nylon 11 coating 303.

Referring to FIG. 3C, a wear-resistant coating 304 was then coated onto the string (e.g., by an extrusion process at temperatures ranging from approximately 240° C. to 280° C.). A nylon 11/clay, nylon 11/CNT nanocomposite, or a clay/CNT co-reinforced nylon 6 nanocomposite may be employed as the wear-resistant coating material 304. The nylon 11 nanocomposite produced by in-situ polymerization may contain 4% nano-clay filler. Other nylon 11 nanocomposites produced by a melt-compounded process may also be used for the wear-resistant coating material 304. Any of the foregoing nylon 11 nanocomposites may also be modified by an impact modifier, such as rubber or elastomer, to improve the ductility and toughness. The thickness of the wear-resistant coating 304 may be from 1 to 100 micrometers.

Except for the extrusion process to deposit a coating on the string, other methods such as spraying, dipping, spin coating, brushing, painting, and immersing processes may be used to deposit a coating on the surfaces of strings. Nylon 6 nanocomposites may be melted at higher than 190° C. and extruded to deposit a coating on the strings. Nylon 6 nanocomposites may be dissolved in a solvent such as formic acid and sprayed, dipped, spin coated, brushed, painted, or immersed to deposit a coating on the string at room temperature or elevated temperatures. The solvent may be then removed by a follow-up process, such as an evaporation method.

Figure 4:
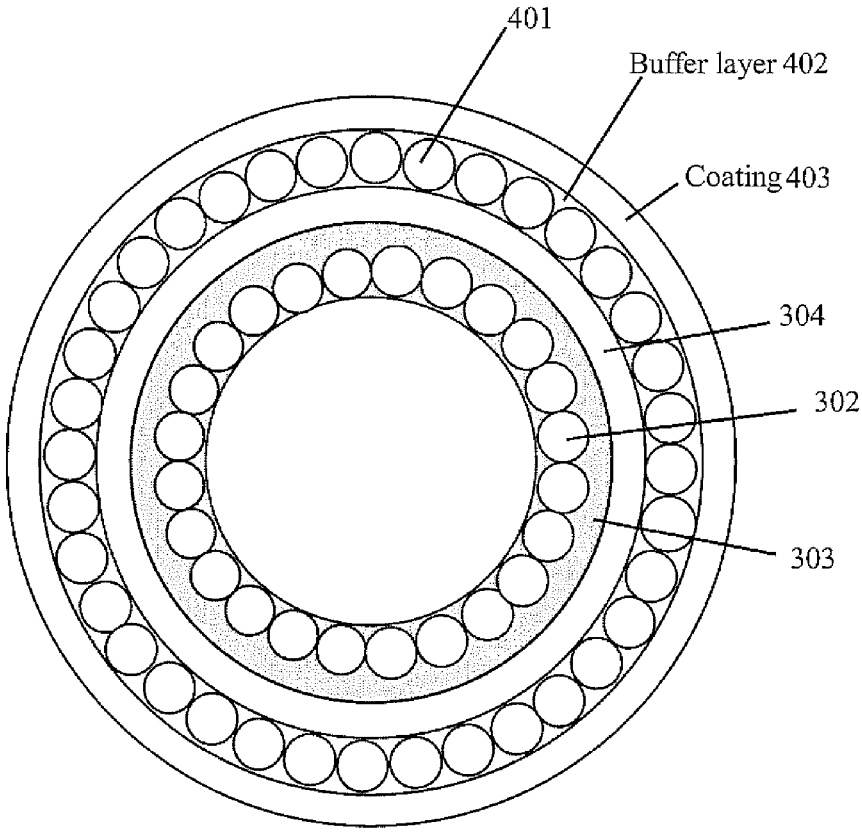
FIG. 4 illustrates another embodiment of the present invention.

FIG. 4 illustrates another embodiment of the present invention. Essentially, the coated string structure of FIG. 3C was then coated again with smaller diameter multi-filaments 401. A buffer layer coating 402, similar to layer 303, was applied (e.g., by an extrusion process at temperatures ranging from approximately 190° C. to 270° C.). The thickness of the buffer layer 402 may be from 10 to 100 micrometers. The gaps between the multi-filaments 401 were substantially fully filled by the neat nylon 6 coating. A wear-resistant coating 403 was then coated (e.g., by an extrusion process at temperatures ranging from approximately 240° C. to 280° C.). A nylon 6/clay, nylon 6/carbon nanotube nanocomposite, or a clay/CNT co-reinforced nylon 6 nanocomposite may be employed as the wear-resistant coating material 403. The nylon 6 nanocomposite produced by in-situ polymerization may contain 4% nano-clay filler. Other nylon 6 nanocomposites produced by a melt-compounded process may also be used for the wear-resistant coating 403. The nylon 6 nanocomposites may also be modified by impact modifiers, such as rubber or elastomer, to improve the ductility and toughness. The thickness of the wear-resistant coating 403 may be from 1 to 100 micrometers. In the foregoing embodiments pertaining to FIG. 4, nylon 11 may also be used instead of or in addition to nylon 6.

Figure 5:
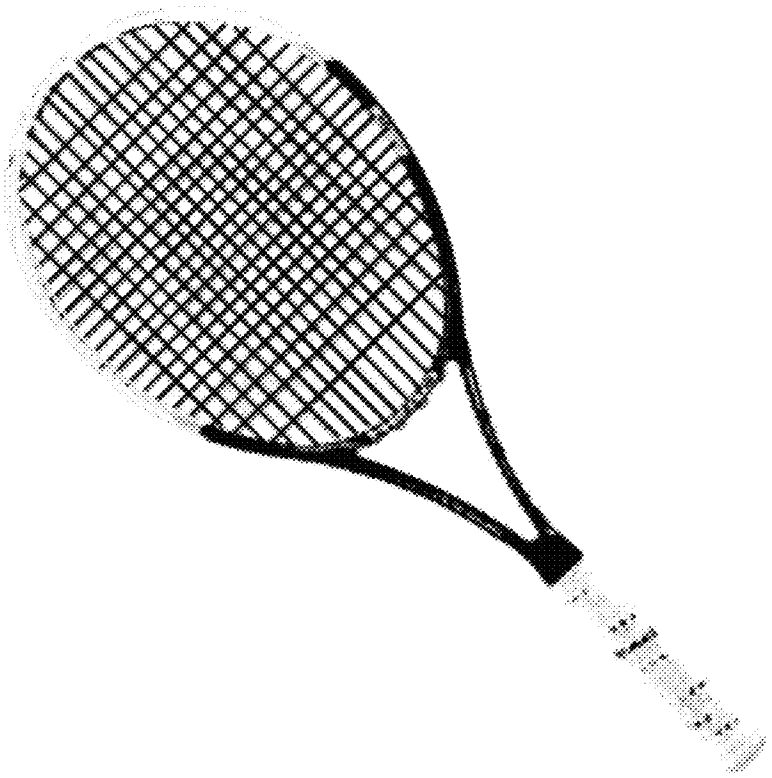
FIG. 5 illustrates a sports racquet configured in accordance with embodiments of the present invention.

FIG. 5 illustrates a sport racquet fitted with a string in accordance with any of the embodiments described herein. A tennis racquet is shown, though any stringed sports racquet that utilizes nylon strings can utilize strings made in accordance with any of the embodiments of the present invention.

Figure 6:
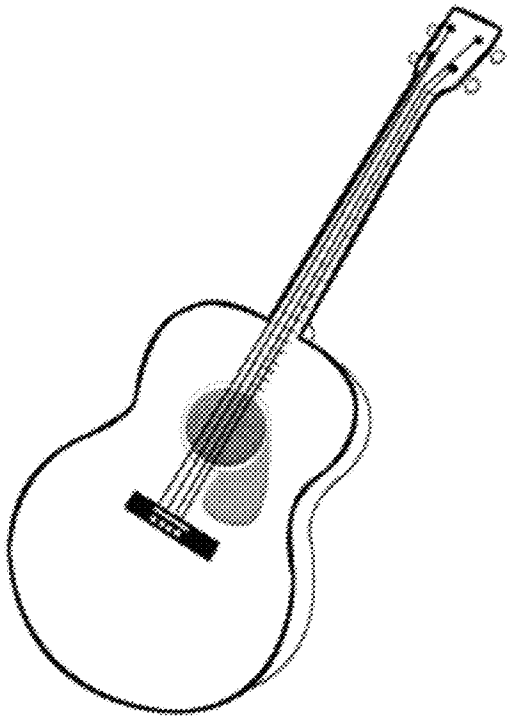
FIG. 6 illustrates a musical instrument configured in accordance with embodiments of the present invention.

FIG. 6 illustrates a musical instrument fitted with a string in accordance with any of the embodiments disclosed herein. A guitar is shown, though any stringed instrument that utilizes nylon strings can utilize strings made in accordance with any of the embodiments of the present invention.

What is claimed is:

1. A string comprising:

a core filament of the string wrapped with a plurality of wrapping filaments of a smaller diameter than the core filament;

a neat nylon buffer layer coating filling in gaps between the wrapping filaments and between the wrapping filaments and the core filament; and an outer coating covering over the neat nylon buffer layer coating, wrapping filaments and core filament, wherein the outer coating comprises a composite of nylon and two or more different materials selected from the group consisting of clay, carbon nanotubes, and an impact modifier.

2. The string of claim 1, wherein the string is in a sport racquet.

3. The string of claim 1, wherein the string is in a musical instrument.

4. The string of claim 1, wherein the neat nylon buffer layer coating consists of neat nylon 6.

5. The string of claim 1, wherein the neat nylon buffer layer coating consists of neat nylon 11.

6. The string of claim 1, wherein the outer coating comprises a composite of nylon, an impact modifier, and clay nanoparticles.

7. The string of claim 1, wherein the outer coating comprises a composite of nylon, clay nanoparticles, and carbon nanotubes.

8. The string of claim 7, wherein the outer coating further comprises an impact modifier.

9. The string of claim 1, further comprising:

another plurality of wrapping filaments wrapped around the outer coating;

another neat nylon buffer layer coating filling in gaps between the another plurality of wrapping filaments; and another outer coating covering over the another neat nylon buffer layer coating.

10. The string of claim 1, wherein the outer coating comprises a composite of nylon and glass particles.

11. The coating of claim 1, wherein the outer coating comprises a composite of nylon and ceramic particles.

12. A string comprising:

a core filament of the string having a first diameter, wherein the core filament is wrapped with one or more wrapping filaments having a second diameter that is less than the first diameter;

a neat nylon buffer layer coating substantially fully filling in gaps between the one or more wrapping filaments and between the one or more wrapping filaments and the core filament; and an outer coating covering over a circumference of the string so that it covers the one or more wrapping filaments and the nylon in the gaps, wherein the outer coating comprises a composite of nylon and two or more different materials selected from the group consisting of clay, carbon nanotubes, and an impact modifier.

13. The string of claim 12, wherein the string is in a sport racquet.

14. The string of claim 12, wherein the outer coating comprises a composite of nylon, an impact modifier, and clay nanoparticles.

15. The string of claim 12, wherein the outer coating comprises a composite of nylon, clay nanoparticles, and carbon nanotubes.

16. A string comprising:

a core filament of the string having a first diameter, wherein the core filament is wrapped with one or more wrapping filaments having a second diameter that is less than the first diameter;

a neat nylon buffer layer coating filling in gaps between the one or more wrapping filaments and between the one or more wrapping filaments and the core filament; and an outer coating covering over a circumference of the string so that it covers the one or more wrapping filaments and the nylon in the gaps, wherein the outer coating comprises a clay nanoparticles and carbon nanotubes co-reinforced nylon composite.

17. The string of claim 16, wherein the string is in a sport racquet.

18. The string of claim 16, wherein the clay nanoparticles and carbon nanotubes co-reinforced nylon composite further comprises an impact modifier.

* * * * *